US005916420A

United States Patent [19]

Wurster et al.

[11] Patent Number: 5,916,420

[45] **Date of Patent: *Jun. 29, 1999**

[54] THIN PRINTING PAPER AND A PROCESS FOR MANUFACTURING SAID PAPER

[75] Inventors: Hartmut Wurster, Friedberg; Hans-Peter Hofmann, Dachau, both of Germany

[73] Assignee: Haindl Papier GmbH, Augsburg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/527,357

[22] Filed: Sep. 12, 1995

[30] Foreign Application Priority Data

Jan. 12, 1994 [DE] Germany ..... 44 00 609

[51] Int. Cl.[6] ..... D21H 19/44; D21H 19/40

[52] U.S. Cl. ..... 162/137; 162/136; 162/135; 162/184; 162/206; 162/175; 162/177; 162/181.8; 488/342; 488/380; 488/403; 427/211; 427/209

[58] Field of Search ..... 162/135, 136, 162/137, 181.8, 184, 181.1, 175, 177, 158, 206; 428/342, 340, 341, 323, 375, 380, 402, 403, 317.5; 427/209, 211, 411, 395

[56] References Cited

U.S. PATENT DOCUMENTS

| | | | |
|---|---|---|---|
| 3,276,359 | 10/1966 | Worthen et al. | 162/137 X |
| 4,064,304 | 12/1977 | Fujita et al. | 428/207 |
| 5,242,545 | 9/1993 | Bradway et al. | 162/135 |
| 5,437,925 | 8/1995 | Macaulay et al. | 428/331 |
| 5,494,509 | 2/1996 | Kruythoff et al. | 106/197.1 |

FOREIGN PATENT DOCUMENTS

| | | | |
|---|---|---|---|
| 2202464 | 9/1988 | United Kingdom | 428/342 |

OTHER PUBLICATIONS

Casey, James P. "Pulp and Paper: Chemistry and Chemical Technology", vol. II, 1952, pp. 938–942, Apr. 1952.

Eklund et al. "Paper Chemistry an Introduction", DT paper science Finland, pp. 12–13 and 213–214, Dec. 1991.

Paul Sennett et al., Influence of Pigment and Binder Type on Performance of Lightweight Coated Sheets, May 15–18, 1983, Tappi Coating Conference (San Francisco), pp. 17–22.

N.–O Bergh et al., Evaluation of Coating Binders for ULWC–Papers, May 17–21, 1987, Tappi Coating Conference (Houston), pp. 151–156.

*Primary Examiner*—Stanley S. Silverman
*Assistant Examiner*—Jose A. Fortuna
*Attorney, Agent, or Firm*—Mary R. Bonzagni, Esq.; Holland & Bonzagni, P.C.

[57] ABSTRACT

The present invention relates to a thin printing paper with a weight per unit area in the range below 49 g/m$^2$ and which contains wood and which is provided with surface pigmentation and which incorporates a mixture of a swellable coating silicate (sodium bentonite) and, for the remainder, conventional coating pigments as the pigment and which, in addition, contains only bonding agent that is a natural organic bonding agent, essentially starch. Even if only lightly calendered, the paper is equally well suited for rotogravure printing and for rotary offset printing. It is preferred that the paper also contain a proportion of processed fibres obtained from old-paper.

37 Claims, 2 Drawing Sheets

THIN PRINTING PAPER AND A PROCESS FOR MANUFACTURING SAID PAPER

FIELD OF THE INVENTION

The present invention relates to a process for manufacturing a thin printing paper, a paper manufactured by using this process, and the use of the aforesaid paper.

BACKGROUND OF THE INVENTION

Thin printing papers are used mainly for printing reference works and catalog-type works, for example, telephone directories, mail order catalogues, and the like. In principle, a distinction is made between two types of paper, namely, the so-called natural, or uncoated, papers that have no special surface coating, and coated papers that today generally have a coating of pigment that is bonded by a synthetic bonding agent. The latter types of paper are referred to as LWC papers (low-weight coated) or, when they are of the lowest weight range per unit area, as ULWC papers (ultra-low-weight-coated). These are the type designations of standard qualities that are commercially available. When they are used, in particular, for rotogravure printing, both natural papers as well as the coated printing papers are super-calendered in order to impart the specific smooth finish that is required for the printing process. The standard designation for super-calendered papers is SC-papers. As a rule, these papers are suitable both for rotogravure printing and for off-set printing. This is not the case with known coated papers. In the case of conventional LWC-qualities, additional information must be provided as to whether they are to be used for rotogravure printing or for offset printing. Coated papers that are used for rotogravure printing must be sufficiently pliable in order that they lie properly on the inking depressions of the rotogravure printing cylinder; because of the easy flowing characteristics of the offset inks, offset papers require great surface strength. These different demands require different manufacturing conditions and, generally speaking, cannot be achieved simultaneously using known manufacturing processes.

Papers with ever-smaller weights per unit area are demanded not only for environmental reasons, in order to reduce the amount of waste paper that is generated, but are demanded mainly in order to save freight costs when transporting paper and to reduce mailing costs when sending out printed matter, for example, mail-order catalogues, for in the case of light-weight paper, the information area is then greater for each unit of weight of the paper.

There are two reasons why there are limits to which the weight per unit area of printing papers can be reduced: on the one hand, for reasons of a still-acceptable strength of the paper, which is important both when the paper is manufactured in a paper-making machine as well as when it is being printed using other high-speed rotary presses; on the other hand, for reasons of the required printing opaqueness, which must not fall below a specific value in order that the paper can be printed on both sides without the image bleeding through to the other side. Generally speaking, a high level of opaqueness can be achieved by having a greater quantity of mechanical wood pulp or pigment in the body paper, or a greater weight of coating on the paper, although this affects the strength of the paper in the case of equal weights per unit area because the proportion of long-fibre paper fibres material (which imparts strength to the paper) must, as a rule, be reduced in such a case.

Coated papers cost more to manufacture than uncoated papers but they have a smoother surface that results in a better print image; however, the synthetic binder, in the form of a hardened polymer dispersion used in the coating substance, is a disadvantage for environmental reasons, and also for re-processing. Very frequently, coated papers that are produced at very low weights per unit area are spongy because of the small percentage of base paper that they contain and also because of the synthetic binding agent that is used, and this can be a disadvantage for handling the paper. If, instead, use is made of an uncoated paper at a low weight per unit area, printing opaqueness and printing brilliance (printing brightness) are reduced and more printing ink bleeds through. Since these known papers have no subsequently applied coating, their opaqueness can only be improved by increasing the amount of filler or mechanical wood pulp in the paper itself. As has been discussed above, this reduces the strength of the paper. However, the strength of the paper is determined not only by the type and processing of the fibre material in the paper, but also by the evenness of the sheet forming in the paper-making machine, because the better the evenness of the paper, the smaller the number of weak points, which are not as strong, there will be; in the final analysis, these cause breaks or tears in the paper web. Generally speaking, uneven sheet forming results in uneven absorption of the printing ink, so that the integrity of the printed image suffers.

For reasons of cost, bulk printing papers are not manufactured from pure pulp, which would give the greatest paper strength, but rather the largest possible quantity of mechanically or thermo-mechanically digested mechanical wood pulp or wood cellulose is used, since this not only entails cost advantages but also improves the opaqueness of the paper and has a positive effect on the printing results that can be achieved. Mechanical wood pulp reduces the strength of the paper that can be achieved or which could be achieved by using pure pulp. In addition, the price situation with respect to bulk printing papers is such that such papers can only be produced economically on very powerful and high speed production machines. Depending on the particulars of the production plant that is used, the raw-material costs relative to unit area for lower paper weights can be reduced, whereas the cost of each unit of weight of the paper that is produced can increase since the reduction of weight per unit area cannot be made up in every case by increasing the speed at which the machines run, in order to maintain even production with respect to weight.

SUMMARY OF THE INVENTION

It is the task of the present invention to describe a process for manufacturing a thin printing paper, whose weight per unit area is below 49 g/m$^2$, which is essentially free of synthetic binding agents, and which, in the range above 50 g/m$^2$, displays a print quality that is the same or better in comparison to conventional uncoated papers, and is of sufficient strength and stiffness that it can be manufactured at high machine speeds and printed in conventional rotary printing presses.

DESCRIPTION OF THE PREFERRED EMBODIMENT

A particular advantage of the new paper is the fact that, as a surface-coated paper, particularly in the preferred version, one and the same type is simultaneously suitable both for rotogravure printing and for rotary offset printing. This is an absolute novelty for surface-coated paper.

Essentially, for reasons of cost, the new paper has a proportion of pulp in the total fibrous material that is less than 40%-wt., despite its low weight per unit area.

The amount of pulp in the overall fibre content of a paper can be determined either microscopically or indirectly by chemical means. These methods are known in the domain of paper testing. A microscopic method of determination based on selective counting of fibres in a microscopic image of one fibre suspension obtained from a paper sample is set out in the US test protocol TAPPI T 401 om-82. In the indirect chemical determination of the amount of pulp, the proportion of fibres that have not been mechanically digested is determined by measuring the lignin that is present, and the amount of pulp is then calculated as a differential. When this is done, the Hagglund method for determining lignin is used.

The following test methods can or are to be used for other features and properties that are relevant to the invention described herein.

| | |
|---|---|
| Mass per unit area | DIN 53 105 Sheet I |
| Ash content | DIN 54 371<br>Zellcheming pamphlet<br>ZM IV/40/77 |
| Smoothness (per Bekk) | DIN 53 107 |
| Gloss | TAPPI T480 om-90 |
| Dry resistance to picking | Fogra Research Report 4.016 |
| Wet resistance to picking | Fogra Research Report |
| Opaqueness | DIN 53 146 |

Unless otherwise noted, all of the quantities and percentages quoted in this description are in proportions by weight relative to solids that have been oven dried.

In the case of the usual printing papers, the pulp that gives the paper its strength generally consists of long-fibre pine pulp and the remaining fibrous material consists of mechanical wood pulp or wood cellulose. In a particular version of the present invention, it is intended that at least 15%-wt. relative to the total fibrous material be used, this having been obtained from recycled paper. It is preferred that this proportion be above 35%-wt.

For reasons of strength, a high proportion of fibrous material obtained from recycled paper can be problematic with respect to papers with very low end weights. In the case of base paper that weighs less than 40 g/m$^2$, in particular less than 30 g/m$^2$, or finished papers weighing less than 44 g/m$^2$, and in particular less than 34 g/m$^2$, the content of fibrous material obtained from recycled old paper should not be more than 50%-wt. relative to the total fibrous material, in which connection the quantity that can be used will depend on the type of old paper itself, and in particular on its long fibre-cellulose content.

In this connection, old paper is not understood to be the paper waste that results during the manufacturing process and which is returned to the process and digested again, since such waste is of the identical composition as the new fibre material. Rather, old paper is understood to be mixed old paper, in particular household material and de-inking ware which has been purchased on the market and re-processed in a special old-paper processing plant.

Even if, according to the present invention, it is attempted to use a high proportion of fibres obtained from old paper, this is not contradictory to a minimally required proportion of cellulose, for the old paper generally contains a specific amount of cellulose that can be replaced by an appropriate amount of cellulose from fresh pulp; an amount of pulp that is below 40% and a percentage of old-paper fibres of approximate the 70 percent are not logically mutually exclusive; however, is preferred that an effort be made to keep the pulp amount in the composition of the fibrous material below 30%-wt.

Up now, the use of old paper in a paper of the type described herein has not been usual. However, the use of old paper can lead to slight greying of the base paper, and this is corrected according to the present invention by the measures that are described below.

In order to impart the required opaqueness to the paper according to the present invention, the base paper should have an ash content of greater than 8%-wt. It is preferred that the base paper have an ash content of more than 12%-wt. Naturally, this means that the pulp suspension that is used for forming the sheets of paper must have an correspondingly higher ash content since some of the ash leaves the freshly formed paper web with the suspension water through the sheet-forming screen, and is essentially returned to the process.

According to the present invention, the sheets for the base paper are formed on a paper-making machine that has a screen speed of greater than 700 meters/minute. As has already being discussed, good sheet forming is necessary in order to achieve adequate paper strength for low basis weights. The lower the basis weight, the better the sheet forming must be.

For this reason, it is preferred that a screen section that is configure at least in the form of a so-called hybrid former be used for manufacturing the paper or base paper according to the present invention; this has a screen section with a second or upper screen which is guided onto the lower screen shortly after the sheet is formed, so that the freshly formed web of paper is guided between the two screens for the continued removal of water from both sides. However, the use of a so-called gap former is preferred; in this, the upper screen is guided onto the lower screen immediately after leaving the pulp suspension, so that the first sheet forming takes place in the merging gap between these two continuously circulating screens as the water is removed from both sides.

The arrangement of the water-removal elements, the backs of which touch the sheet-forming screen and which provide for the gentlest possible removal of excess suspension water from the web of paper, is also important for achieving good sheet forming. For this reason, the use of a double-screen section with a gap former has been found to be particularly advantageous for the process according to the present invention.

If necessary, a smaller quantity of a wet consolidating agent can be used during production of the base paper. It is preferred that no such agent be used.

The subsequent treatment of the web of base paper after it leaves the screen section, namely, the continued removal of water from the web in a press section and subsequent drying in a drying section are familiar to the practitioner skilled in the art.

According to the present invention, the base paper that is produced ha s a weight per unit area of less than 46 g/M$^2$, in particular less than 40 g/M$^2$, and most particularly less than 30 g/M$^2$, t o as little as 23 g/M$^2$. The amount of ash in the base paper can amount to more than 8 to 30%-wt., depending on the weight per unit area, and it is preferably above 12%-wt.

The fillers that are usually used when manufacturing paper, and which determine the ash content, are already known. According to the present invention, calcium carbonate, kaolin, or talcum, and mixtures of these fillers are used for the base paper. In addition, the usual agents are used for either an acid or neutral method of manufacture. When old paper is also used, it is preferred that production of the base paper take place in a neutral suspension medium. Generally speaking, this is also a prerequisite for using calcium carbonate as a filler.

It is preferred that the base paper be produced at screen speeds of greater than 1000 meters/minute, providing the usual conditions permit this.

According to the present invention, once the base paper has been sufficiently dried the thin printing paper is coated on both sides with a naturally bonded surface film that contains a pigment. The expression "naturally bonded" implies that the surface film or the coating has being produced without any synthetic, organic bonding agents. The natural bonding agents that are used according to the present invention are both organic and inorganic. The natural organic bonding agents are, for example, casein, protein, cellulose derivatives such as carboxymethyl cellulose (CMC), polyvinyl alcohol (PVA), and, in particular, starches that have been appropriately processed (gelatinized) or, if necessary, modified by chemical means. The correct processing of these natural bonding agents is familiar to the practitioner skilled in the art. What is preferred is the use of starches that have been modified by way of a specific plastification which, after the paper has been dried, result in a surface film that is less brittle than when native, gelatinized starch is used. Esterified starches, for example, phosphate starches, as well as, in particular, etherified starches have been found to be both useful and suitable. In order to be able to exploit the effect of such starches in the finished paper, the finished paper should be dried to a moisture content of no less than 7%-wt. Residual moisture in the range of 8%-wt. have been found to be advantageous.

Suitable conventional coating pigments for the surface treatment mixture are, for example, natural or modified kaolin, calcium carbonate, mica, and talcum. A possible coating mixture can contain one of these pigments exclusively as the usual colouring pigment, or a mixture of them in any ratio.

Essentially, the surface coating for paper according to present invention consists of a mixture of natural organic bonding agents, conventional colouring pigments, and a swelling silicate, in general a sodium bentonite that is suitable for the paper coating. The sodium bentonite is a type of inorganic pigment (in the sense of this description, however, it is not taken to be a conventional coating pigment), but at the same time it has a bonding effect on the paper coating, for which reason it can be considered to be an inorganic, natural bonding agent.

In principle, the use of a bentonite in the paper coating is already known, for example from DE-C-736 450. This describes the fact that a bentonite can be used, on the one hand, as an exclusive bonding agent for the paper coating, or in combination with starch. The positive effect of the bentonite on the results of printing carried out by various printing processes has already been described. This and other publications that already indicate the applicability of bentonite do not, however, reveal the special conditions under which an extremely light-weight rotary printing paper can be produced; one which displays the imprinting properties of the rotary printing papers already available on the market and which, in preferred forms, is equally suitable both for rotogravure and for offset printing.

Not every kind of bentonite has equally good properties, and many of the bentonites that occur naturally still require specific pre-treatment in order to impart an adequate bonding effect to them for the paper coating. The expert can select suitable bentonite from the products that are commercially available.

According to the present invention, within the widest range, provision is made for a mixture of a sodium bentonite with conventional coating pigments in a weight ratio of>20 to≦60 up to 95, to 5, in which connection the amount of natural, organic bonding agent (not taking into account bentonite that is understood to be an inorganic binding agent), lies within range of 1 to 15 parts by weight relative to this pigment mixture. This is understood to be the lower limiting quantity of the organic combination in conjunction with the greatest amount of bentonite, and vice versa. However, it is preferred that an amount of bentonite of at least 40 parts by weight be used in the pigment mixture, when the maximal admixture of organic bonding agent should not amount to more than 10 percent. In a particularly preferred embodiment, the bentonite content is between 40 and 60 parts by weight, relative to the pigment mixture, when the content of organic bonding agent is between six and ten parts by weight, relative to this pigment mixture. Excellent results can be achieved with a mixture of 50 parts by weight of sodium bentonite and 50 parts by weight of conventional coating pigment and an organic bonding agent, in particular starch, amounting to 8%-wt., relative to this mixture. Essentially, kaolin and calcium carbonate or mixtures of these two pigments are used as the normal coating pigment, when a small quantity of other pigments, such as titanium dioxide, can also be used in order to improve the degree of whiteness and other secondary characteristics.

If starch is used as an organic bonding agent, if necessary up to 10 percent of carboxymethyl cellulose (CMC) can be added to it. In general, the effect of the CMC is to thicken the coating mixture, and it can be dispensed with if greater quantities of bentonite are used. For the remainder, CMC has a negative effect on the rotogravure printing process.

Depending on the amount of bentonite, the solids content in the coating mixture that is to be prepared lies between 15 and 55%-wt. Because of the marked swelling properties of the bentonite, the smaller solids contents apply to the greater quantities of bentonite. If greater quantities of bentonite are used it is also expedient to use a dispersant. The application mass relative to area lies in each case below 5 $g/m^2$ on each side of the paper. Preferred is an application weight between 1.5 $g/m^2$ and 2.5 $g/m^2$ on each side. In particular in the case of a large quantity of bentonite in the coating mixture, the application quantity can as a rule be less than 2 $g/m^2$.

According to the present invention, essentially indirect roller application systems, so-called film presses, are used as the application systems; in these, the coating mixture is transferred evenly to the surface of an application roller by means of a pre-dosing system, for example, a wire-wound roller or a profiled doctor blade; in its turn, the application roller transfers the film to the surface of the paper. In general, the paper web is processed simultaneously on both sides, when each application roller simultaneously serves to provide the counter pressure for the other application roller. It is also possible to use a so-called kiss method, in which the web of paper passes between the rollers and only touches them without any special pressure being applied. Suitable film presses are the system is that are marketed by Jagenberg, the Voith "Speedsizer," the Valmet "Symsizer," and the TWIN-HSM roller application system manufactured by the Swedish company BTG.

The surface treatment can be carried out in the paper-making machine or in a separate system.

Regardless of whether this is done within the paper making machine or outside of it, coating the paper with aqueous pigment suspensions imposes a great strain on the paper since it is soaked with the aqueous coating in the direction in which it is coated and, at the same time, is subjected to even higher stresses because of the application system. The base paper that is to be coated must thus be sufficiently strong, particularly when damp (wet strength). For this reason, the reduction of the weight per unit area of a base paper that is to be coated, as a function of the type of application system, has limits imposed upon it. Base papers with 47 to 53%-wt. pulp are less delicate. At less than 40 or even 30%-wt. cellulose in the total fibre, however, light weight base papers can give rise to considerable strength and production problems.

For this reason, the use of a film press for surface coating is preferred when manufacturing the papers according to the present invention. The film press results in relatively short contact times of the paper with the coating since the quantity that is applied is pre-dosed onto the application rollers and the paper only comes into contact with the correct quantity of ink, and not with an excess thereof, indirectly in the gap between the rollers and which, as in the rake procedure, for example, has to be removed from the paper itself. In addition, the film press exerts only a limited mechanical load on the paper. If necessary, it can be operated with little or scarcely any application pressure. Up to now it has not been possible to coat light base papers with the limited amount of cellulose according to the present invention, using a rake system, for example, as is usual when manufacturing light-weight rotogravure printing papers.

The use of a film press to manufacture the papers according to the present invention entails the added advantage that by using such a press it is possible to apply a relatively even although thinner film to the paper, regardless of its surface structure, and this has an advantageous effect on the printing results that can be obtained.

If the problem of applying a surface film that contains pigments is addressed in context of the present invention, this does not pre-suppose that the film is completely self-contained. Rather, this involves a coating that transforms the outermost fibres of the paper surface into something approximating film-binding fibres.

The paper that has the surface film that contains pigment is then dried in an appropriate manner and subsequently calendered in order to improve its surface finish. According to the present invention, thin printing papers that are intended to be suitable for rotogravure printing are subjected to a super-calendering process.

It is preferred that the finished paper have a weight per unit area that is less than 44 g/m$^2$, when the ash content of the total paper in the case of practically made papers is between 12 and 25%-wt., preferably above 15%-wt. It is also possible to obtain weights per unit area below 34 g/M$^2$.

The thin printing paper that is produced according to the present invention displays astonishingly good print opaqueness despite its low weight per unit area and a surface quality and print-reproduction quality that is seldom achieved even with a pure glazed natural paper in a weight range per unit area of 50 g/m$^2$.

In addition to the foregoing, the thin printing paper according to the present invention is environmentally friendly since, when it is recycled, it generates no waste water, for it is free of organic-synthetic bonding agents that contain such harmful substances. The thin printing paper according to the present invention displays very low air permeability because of good sheet forming in conjunction with a large ash content in the base paper itself and in the additional surface film, and this permeability is even less than in the case of low-weight coated papers.

The paper according to the present invention also exhibits a particularly fine print brilliance and even absorption of printing ink. Because of the high proportion of filler in the light-weight base paper, an extremely even and continuous surface can be achieved even when the smallest quantities of ink are applied with a film-forming service treatment, which permits high surface quality and even absorption of the printing ink, despite the low weight per unit area. Most surprisingly, it has been found that the ultra-light thin printing paper according to the present invention is equally good for the two most important printing processes, namely, offset printing and rotogravure printing. Apart from certain types of cardboard stock, no medium weight coated printing paper (MWC papers), low weight coated printing papers (LWC papers) and ultra-light coated printing papers (ULWC papers) that satisfy the demands imposed by both printing processes to a sufficient degree are known. In general, both printing processes require different qualities of paper in order to achieve good print quality.

If the surface smoothness of LWC papers is selected so as not to be too high in the rotary-offset range, e.g., 1000 to 2600 Bekk-seconds, in order that the water that is contained in the base paper matrix can escape through the coating and ink layer when the ink is dried with hot air, in order to create optimal surface geometries and consequently contact areas for the inking cups in the rotogravure process, smoothness values in the range of 2800 to 2500 Bekk-seconds are required. Calendered natural papers are in the smoothness range from 1200 to 2800 Bekk-seconds. After calendering, the paper according to the present invention is suitable for rotogravure printing up to a smoothness of only approximately 500 to 600 Bekk-seconds after calendering in a 10-roller super calender at a line pressure of approximately 1130 Kilonewtons/meter.

The great suitability of the paper according to the present invention, with a percentage of approximately 8% starch for both main printing processes is also surprising, because LWC rotogravure paper usually contain only 4.0 to a maximum of 5.0% of a plastic binder that swells in an alkaline environment in the coating. Starches, which were previously preferred for use according to the present invention, normally reduce the compressibility of the paper matrix and lead to a contraction of the coating when drying, for which reason the surface smoothness and paper softness that is required for optimal rotogravure ink transfer is, in part, lost. Printing papers with a pure starch-kaolin coating are not suitable for rotogravure printing. On the other hand, the rotary offset printing process imposes far greater demands on the coating bonding than the rotogravure printing presses, because of the greater viscosity of the printing ink and the greater elasticity of the ink, and for this reason binding agent quantities of 13 to 20%, mostly plastic binding agents mixed with starch, are usual in LWC coating ink receptacles for offset papers. The fact that a surface coating with only 8% starch as a binder runs without any problem, i.e., without a rubber coating, through a multi-colour offset rotary press is even more surprising since starch lies below polyvinyl alcohol, synthetic binding agent, and CMC in the binding-strength scale. The combination of the natural organic bonding agents with the sodium bentonite seems to have a special effect.

BRIEF DESCRIPTION OF THE DRAWINGS

Production systems for the papers described above are shown diagrammatically in the drawings appended hereto in order to better explain the present invention, and these are described in greater detail using the embodiments that follow. These drawings show the following.

EMBODIMENT I

A base paper with a weight per unit area of 26.5 g/m$^2$ and an ash content of 13%-wt. was produced from a fibre mixture containing 34%-wt. pulp, 44%-wt. mechanical pulp and 22%-wt. old paper fibre, relative to the total fibre material, using a high-speed paper-making machine with a production speed of 1300 meters/minute, using a double-screen section, i.e., a gap former of the CDF "Duoformer" type.

Figure 1:
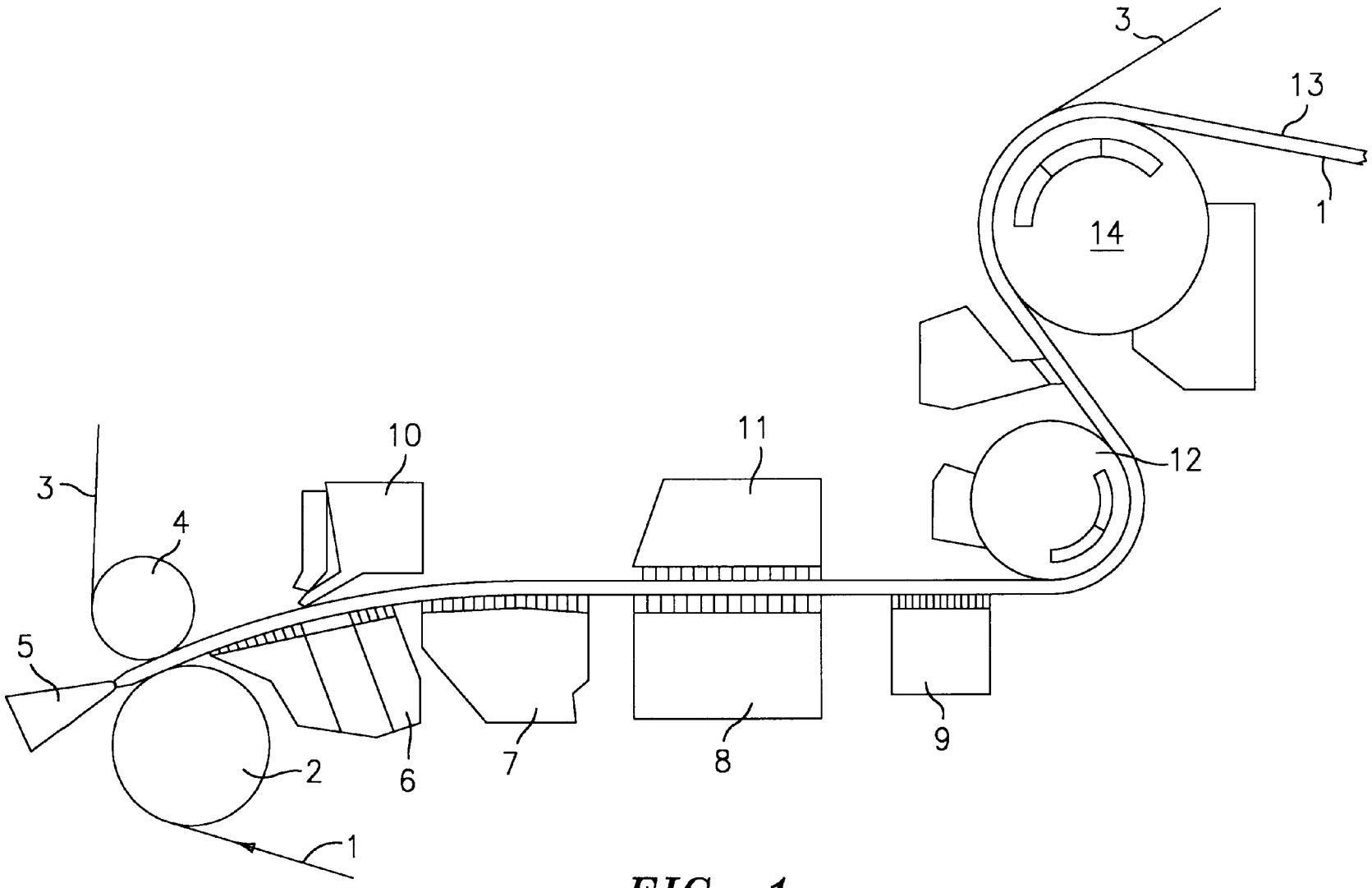
FIG. 1: a diagrammatic illustration of a double-screen section (gap former) of the CDF Duoformer type.

A CDF Duoformer double-screen former is shown diagrammatically in FIG. 1; this is the type that is used to manufacture the base paper. The double-screen former has two rotary sheet-forming screens and these are shown only in their working run. These are a lower screen 1, that runs into the sheet-forming section over a breast roller 2, and an upper screen 3 that merges with the lower screen 1 over a guide roller 4, directly above the breast roller 2. Ahead of the gap that is formed by the breast roller 2 and the guide roller 4 there is the run-out lip by of a pulp box (not shown herein) for the greatly diluted paper pulp suspension. The paper pulp suspension that is provided for sheet forming moves into the gap between the breast roller 2 and the guide roller 4 immediately between the two screens 1 and 3. Further on in the sheet forming section, on both sides of the screens 1 and 3 that enclose the fibre suspension for the sheet forming on both sides in the manner of a sandwich, there are water removal systems 6 to 11. The former that is shown here uses no vacuum-operated water-removal systems, either in the immediate suspension intake area or in the sheet forming zone. The breast roller 2 and the guide roller 4 are solid rollers and in the case of the water-removal systems 6 to 11 these are essentially doctor blades that remove the suspension water that passes through the screen. Only at the end of the sheet-forming section is there a forming roller 12 that incorporates a vacuum chamber, and this applies suction to the web 13 of paper from the upper screen 3. This is adjacent to a screen-suction roller 14 that also incorporates a vacuum chamber that applies suction from the side of the lower screen 1 and on which the upper screen 3 is moved away from the paper web so that this then lies unrestrained on the lower screen 1, when it passes onto the other stations in the paper-making machine, namely, first to a press section and then to a drying section.

The base paper that is produced, and which has a breaking load of 30 N in the longitudinal direction and 7 N in the transverse direction, was given a surface coating on both sides in the paper-making machine itself, which is to say at the same speed of approximately 1300 meters/minute in a film press. The coating mixture contains a pigment mixture of 50 parts by weight kaolin and 50 parts by weight of a sodium bentonite. Relative to the quantity of pigment, 8% starch was added as a binding agent, together with 0.8% calcium stearate as a smoothing agent and 1.2% of a conventional wetting agent. The solids content of the coating mixture amounted to 30.2 g/m$^2$ and it had a Brookfield viscosity of 1200 mPa.s.

Figure 2:
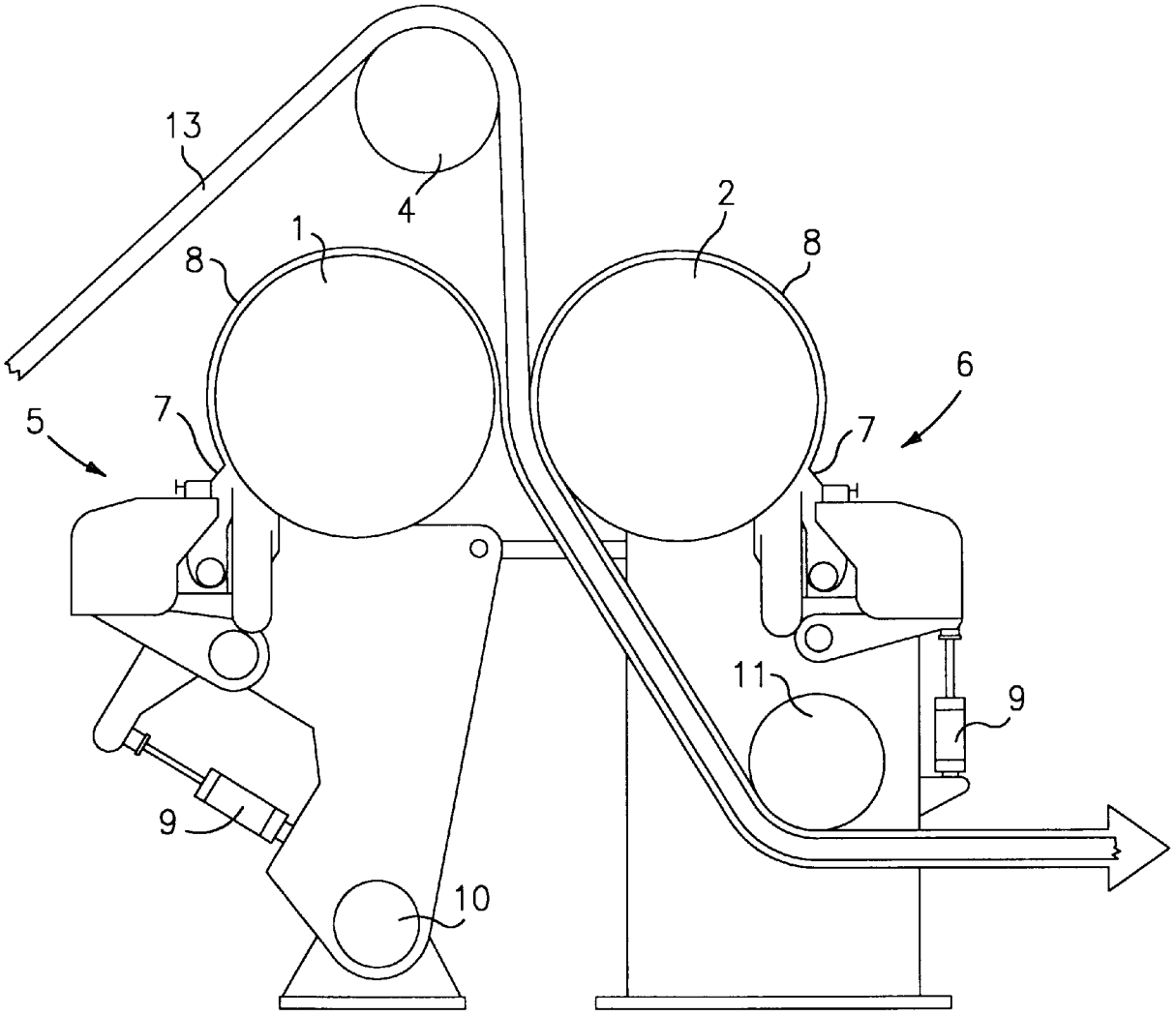
FIG. 2: a diagrammatic representation of a film press.

FIG. 2 is a diagrammatic drawing of the film press that is used. This has two application rollers 1 and 2, between which the web 13 of paper is introduced over a guide roller 4. Each of the application rollers 1 and 2 has an inking metering system 5, 6. In each instance, an important component of the ink metering system is the metering bar 7; in the embodiment that is shown, this is a grooved metering bar with which a layer 8 of coating ink that is of a controlled thickness is produced on the application rollers 1 and 2, as can be seen in FIG. 2. This is then transferred onto the web of paper when it is squeezed between the two rollers. The distance of the metering arm 7 from the particular roller surface can be controlled or regulated by the adjusting cylinder 9. The fact that the two application rollers can be moved towards each other and away from each other by the articulated arrangement of the left-hand application roller is indicated at 10. After passing through the application system, the web of coated paper passes over an additional guide roller 11 to a paper dryer (not shown herein) in the paper-making machine. In the example that is shown, 2 g/m$^2$ per side is applied to the web of paper. The base paper contains 6.0% moisture when it enters the machine.

The result is a finished paper that leaves the paper-making machine with a mass per unit area of 30.5 g/m$^2$, and this was then calendered in a ten-roller super-calender at a speed of 300 meters/minute, a line pressure of 130 Kilonewton/meter and at a temperature of 90 degrees centigrade. This resulted in a glaze of 520 Bekk-seconds on the upper side of the paper and 460 Bekk-seconds on the screen side. The paper lustre amounted to 25% (top) and 20% (screen side). The opaqueness was 78%, and the ash content of the finished paper was 18.6%. The paper's dry pick resistance was very good, and its wet pick resistance was good.

As a comparison paper, a printing paper with a fibre mixture of 38%-wt. pulp and 62%-wt. mechanical wood pulp, but with no old paper, was produced directly with a weight per unit area of 30.5 g/m$^2$; this was done using the identical paper making machine and under almost identical production conditions. The paper was not coated but was subsequently calendered in a twelve-roller super-calender at a speed of 750 meters/minute, at a line pressure of 190 Kilonewton /meter and at a temperature that averaged 90° Centigrade to produce a glaze of 1200 (top) and 2500 (screen side) Bekk-seconds. For the remainder, the test data discussed above were similar to those pertaining to the paper according to the present invention.

The following comparative data were established during testing said of suitability for printing:

TABLE I

| | Paper according to present invention | Comparison paper |
|---|---|---|
| Optical density (%) | 98 | 94 |
| Bleed-through (%) | 9 | 12 |
| Translucency (%) | 16 | 18 |

The paper according to the present invention could be printed without any problems during tests, both using the rotogravure print process and the rotary offset process. The absorption of printing ink was extremely even in both print processes and was better than that of the comparison paper. The printing opaqueness was somewhat higher in the case of the paper according to the present invention than it was with the comparison paper; the print lustre was significantly better (paper according to the present invention: 35 percent; comparison paper: 21 percent) and there was no bleed-through of the printing ink, although this was relatively pronounced in the case of the comparison paper A light-weight, wood-free, thin printing paper of foreign manufacturer was also used for test purposes, and this was assessed as being similar to the natural paper containing wood that was produced here.

EMBODIMENT II

A paper according to the present invention was manufactured using the same composition and production data as in Embodiment I; this was coated with a coating mixture that was the same as in Embodiment I, although it was based on a base paper with a weight per unit area of 31 g/m$^2$; this was given a coating of 2 g/m$^2$ in order to produce a finished paper with a weight per unit area of 35 g/m$^2$. This paper was compared with a commercially-available, natural, uncoated SC paper of 34.5 g/m$^2$, and ULWC paper suitable for rotary off-set printing (Ro) of 35 g/m$^2$ and with a UlWC paper, also of 35 g/m$^2$, suitable for rotogravure printing (TD). The essential test data for these four papers are set out in Table II that follows.

The printing evaluation at the end of the table is particularly important. According to this, the paper according to the present invention is suitable both for rotogravure printing as well as for rotary offset printing (Note 2), whereas although the specialized ULWC papers were suitable for each printing pivoting process for which they were intended, they were unsuitable for the other printing processes. Even the SC paper that was suitable for both printing process was not as well suited for rotogravure printing as the paper according to the present invention. It should also be mentioned here that the paper according to the present invention, in this embodiment, was calendered to a higher smoothness than the paper described in Embodiment I, so that its lustre was more or less comparable with commercially available ULWC papers. The coating weight of the coated comparison papers was about twice as high as that used for the paper according to the present invention. The total ash content of the paper according to the present invention was somewhere below that of the coated comparison papers, which was explained in part by their greater coating weight.

TABLE II

| Paper type | SC | ULWC | ULWC TD | Invention |
|---|---|---|---|---|
| Base paper wt. g/m$^2$ | 35.0 | 27.0 | 27.0 | 31.0 |
| Coating wt., top, bottom, g/m$^2$ | — | 4.0/4.0 | 4.0/4.0 | 2.0/2.0 |
| Finished paper, calendered | | | | |
| Wt. per unit area, g/m$^2$ | 34,5 | 35,0 | 35.0 | 35.0 |
| Ash, % | 14.0 | 20.0 | 21.0 | 19.0 |
| Breaking load long/trans, N | 36/10 | 42/11 | 36/10 | 42/11 |
| Smoothness, Bekk/sec | 700/710 | 1050/1000 | 1200/1300 | 1160/1150 |
| Lustre, 75° | 25/26 | 40/32 | 30/32 | 33/34 |
| Opaqueness, % | 83.0 | 84.5 | 84.5 | 83.5 |
| Brightness, % | 73.0 | 72.0 | 74.0 | 70.0 |
| Pick resistance, dry Note | 4 | 1 | 4 | 1 |
| Pick resistance, wet Note | 1 | 3–4 | 6 | 2 |
| Ink bleed-through | Very marked | 0 | 0 | Very slight |
| Print translucency | Marked | Slight | Slight | Slight |
| Rotary offset printability, Note | 2 | 1 | — | 2 |
| Rotogravure printability, Note | 4 | — | 1–2 | 2 |

Having thus described the invention what is claimed is:

1. A process for manufacturing a thin printing paper with a weight per unit area in the range of less than 49 g/m$^2$ to 24 g/m$^2$, which process comprises: preparing a base paper, with a weight per unit area of less than 46 g/m$^2$, from a paper fibre mixture comprising less than 40%-wt. cellulose, relative to the total fibre material, and with an ash content that results in an ash content of greater than 8%-wt. in the base paper, on a paper-making machine running at a screen speed of greater than 700 meters/minute; and, coating said base paper on both sides, either within or outside the paper-making machine, with a surface film that contains pigments and that has a weight per unit area of less than 5 g/m$^2$, oven dried per side, and which is free of synthetic-organic bonding agents, is naturally bonded, and which comprises a coating pigment mixture whose solid content comprises a mixture of a swellable coating silicate, and mineral coating pigments, in a weight ratio of between 40 to 60 parts by weight, relative to the pigment mixture, of a swellable coating silicate and 60 to 40 parts by weight, relative to the pigment mixture, of mineral coating pigments and a natural organic bonding agent within a range of 1 to 15 parts by weight relative to the mixture, which is dry in each instance, and additives such as agents that affect the rheology, dyes, and wet-strength agents.

2. The process of claim 1, wherein the mineral coating pigments are selected from the group consisting of kaolin, calcium carbonate, mica, talcum and mixtures thereof.

3. The process of claim 1, wherein the swellable coating silicate is a sodium bentonite.

4. The process of claims 3 or 2, wherein the coating pigment mixture comprises: a mixture of sodium bentonite and kaolin and/or calcium carbonate; and, a quantity of organic bonding agents that is between 1 and 10 parts by weight relative to the mixture.

5. The process of claim 4, wherein the quantity of the organic bonding agents is between 6 and 10 parts by weight, relative to the mixture.

6. The process of claim 1, wherein the natural organic bonding agent comprises a starch and optionally, up t 10%-wt, relative to the organic bonding agent, of carboxymethyl cellulose.

7. The process of claim 6, wherein the natural organic bonding agent comprises an etherified starch.

8. The process of claim 1, wherein the base paper has an ash content of greater than 12%-wt.

9. The process of claim 1, wherein the paper fibre mixture further comprises at least 15%-wt. of fibre material obtained from processed recycled paper, relative to oven-dried total fibre.

10. The process of claim 1, wherein the base paper has a weight per unit area of less than 40 g/m$^2$.

11. The process of claim 10, wherein the base paper has a weight per unit area of less than 30 g/m$^2$.

12. The process of claims 10 or 11, wherein the paper fibre mixture further comprises between 15 and 50%-wt. of fibre material obtained from processed recycled paper, relative to oven-dried total fibre.

13. The process of claim 1, wherein the surface film that is coated on each side of the base paper has a weight per unit area in the range of 1.5–2.5 g/m$^2$.

14. The process of claim 13, wherein the surface film that is coated on each side of the base paper has a weight per unit area in the range of 1.5 to less than 2 g/m$^2$.

15. The process of claim 1, wherein the coating pigment mixture is an aqueous coating ink solution having a solid content between 15 and 50%-wt.

16. The process of claim 15, wherein a roller-type application system is used to coat the base paper with the aqueous coating ink solution.

17. The process of claim 16, wherein the roller-type application system operates indirectly and has a pre-dosing element, and wherein the roller-type application system applies an even coating of a pre-measured amount of the aqueous coating ink solution to the application rollers.

18. The process of claim 1, which further comprises: drying the coated base paper; and calendering the dryed, coated base paper.

19. The process of claim 1, wherein the thin printing paper has a moisture content of greater than or equal to 7%-wt.

20. The process of claim 1, wherein the base paper is prepared on a paper-making machine comprising a double screen section or hybrid former, wherein the hybrid former comprises a lower screen and at least one upper screen, and wherein, upon formation of a base paper web, water is continuously removed from both sides of the web through the screens of the hybrid former.

21. The process of claim 1, wherein the base paper is prepared on a paper-making machine comprising a double screen section or gap former, wherein the gap former comprises a lower screen and at least one upper screen, and wherein, upon deposition of a paper-pulp suspension onto the lower screen, the upper screen is guided onto the lower screen and water is continuously removed from both sides of the suspension through the screens of the gap former.

22. The process of claim 1, wherein the base paper is prepared on a paper-making machine running at a screen speed of at least 1000 meters/minute.

23. The process for manufacturing a thin printing paper of claim 1, wherein said solid content of said coating pigment mixture further comprises an effective amount of smoothing agent calcium stearate.

24. A thin printing paper with a weight per unit area in the range of less than 49 g/m$^2$ to 24 g/m$^2$, which comprises: a base paper comprising a paper fibre mixture comprising less than 40%-wt. cellulose, and having an ash content of greater than 12%-wt. oven-dried; and a surface film that contains pigments, which is applied to both sides of the base paper, wherein the surface film has a weight per unit area of less than 5 g/m$^2$ on each side and is free of synthetic-organic bonding agents and which comprises: a coating pigment mixture whose solid content comprises a mixture of a swellable coating silicate, and mineral coating pigments, in a weight ratio of between 40 to 60 parts by weight, relative to the pigment mixture, of a swellable coating silicate and 60 to 40 parts by weight, relative to the pigment mixture, of mineral coating pigments, a natural organic bonding agent within a range of 1 to 15 parts by weight relative to the mixture, and additives, in which connection the ranges of weight ratios relate to the oven-dried state.

25. The thin printing paper of claim 24, wherein the swellable coating silicate is a sodium bentonite.

26. The thin printing paper of claim 24, wherein the mineral coating pigments are selected from the group consisting of kaolin, calcium carbonate, mica, talcum and mixtures thereof.

27. The thin printing paper of claim 24, wherein the natural organic bonding agent comprises a starch and optionally, up to 10%-wt, relative to the organic bonding agent, of carboxymethyl cellulose.

28. The thin printing paper of claim 24, wherein the paper has a weight per unit area of less than 44 g/m$^2$.

29. The thin printing paper of claim 28, wherein the paper has a weight per unit area of less than 34 g/m$^2$.

30. The thin printing paper of claim 24, wherein the paper has an ash content of greater than 15%-wt oven dried.

31. The thin printing paper of claim 24, wherein the paper is calendered.

32. The thin printing paper of claim 24, wherein the surface film that is coated on each side of the base paper has a weight per unit area in the range of 1.5–2.5 g/m$^2$.

33. The thin printing paper of claim 24, wherein the paper fibre mixture further comprises at least 15%-wt. of fibre material obtained from processed recycled paper, relative to oven-dried total fibre.

34. The thin printing paper of claim 24, wherein the paper fibre mixture further comprises at least 35%-wt of fibre material obtained from processed recycled paper, relative to oven-dried total fibre.

35. The thin printing paper of claim 24, wherein the paper fibre mixture further comprises less than or equal to 50%-wt of fibre material obtained from processed recycled paper, relative to oven-dried total fibre.

36. The thin printing paper of claim 24, wherein said solid content of said coating pigment mixture further comprises an effective amount of smoothing agent calcium stearate.

37. A supercalendered thin printing paper with a weight per unit area in the range of less than 49 g/m$^2$ to 24 g/m$^2$, for use as rotary printing paper for rotary offset and rotogravure printing processes, which comprises:

a base paper comprising a paper fibre mixture comprising less than 40%-wt. cellulose, and having an ash content of greater than 12%-wt. oven-dried; and a surface film that contains pigments, which is applied to both sides of the base paper, wherein the surface film is free of synthetic-organic bonding agents and has a weight per unit area of less than 5 g/m$^2$ on each side, and which comprises a coating pigment mixture whose solid content comprises a mixture of a swellable coating silicate and mineral coating pigments in a weight ratio of between 40 to 60 parts by weight, relative to the pigment mixture, of a swellable coating silicate and 60 to 40 parts by weight, relative to the pigment mixture, of mineral coating pigments, a natural organic bonding agent within a range of 1 to 15 parts by weight relative to the mixture, and additives, wherein the ranges of weight ratios relate to the oven-dried state, wherein the thin printing paper is supercalenderedafter application of the surface film to the base paper.

* * * * *